United States Patent [19]

Hermle et al.

[11] Patent Number: 4,459,441

[45] Date of Patent: Jul. 10, 1984

[54] SIMPLIFIED LIMIT SWITCH CONSTRUCTION

[76] Inventors: Rolf Hermle, AM Nussberg 1, D-7440 Nürtingen-Hardt; Klaus Hermle, Römerstrasse 11, D-7303 Neuhausen, both of Fed. Rep. of Germany

[21] Appl. No.: 359,265

[22] Filed: Mar. 18, 1982

[30] Foreign Application Priority Data

Mar. 27, 1981 [DE] Fed. Rep. of Germany ..... 3112088

[51] Int. Cl.[3] ..... H01H 3/12

[52] U.S. Cl. ..... 200/47; 200/340; 361/351

[58] Field of Search ..... 361/350, 351; 200/47, 200/159 R, 153 T, 153 V, 328, 330, 340, 329

[56] References Cited

U.S. PATENT DOCUMENTS 4,168,408 9/1979 Yamane ..... 200/47

FOREIGN PATENT DOCUMENTS 1689197 9/1954 Fed. Rep. of Germany .
1640306 12/1971 Fed. Rep. of Germany .
7318919 9/1973 Fed. Rep. of Germany .

*Primary Examiner*—G. P. Tolin
*Attorney, Agent, or Firm*—Shenier & O'Connor

[57] ABSTRACT

Multiple limit switch comprising telescope plungers (16), each of which has a U-shaped anti-rotation element (62) engaging over the inner end of the plunger, this anti-rotation element comprising a hole (68) for the inner portion (44) of the plunger to pass through and forming an abutment for the plunger return spring (70). The outer portion (40) of the plunger has a collar (56; 56'), behind which projections (64) of the anti-rotation element (62) engage, this outer portion (40) having lateral flattened portions (58; 58') to secure the outer portion (40) of the plunger against relative rotation. The flattened portions abut against slide guide surfaces (60) of the anti-rotation element (62) or edges (64') of the latter. The anti-rotation element (62) is non-rotatably held in an inner groove (30) of the limit switch housing (10).

9 Claims, 5 Drawing Figures

Figure 1:
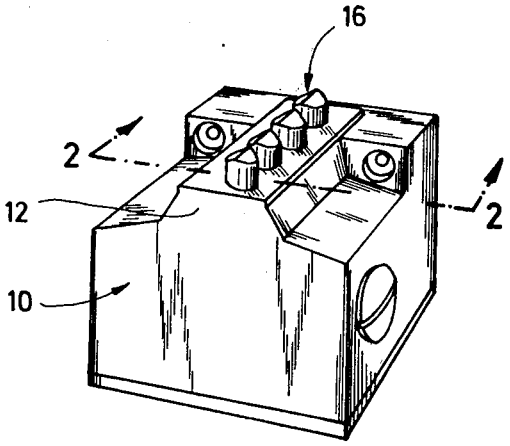

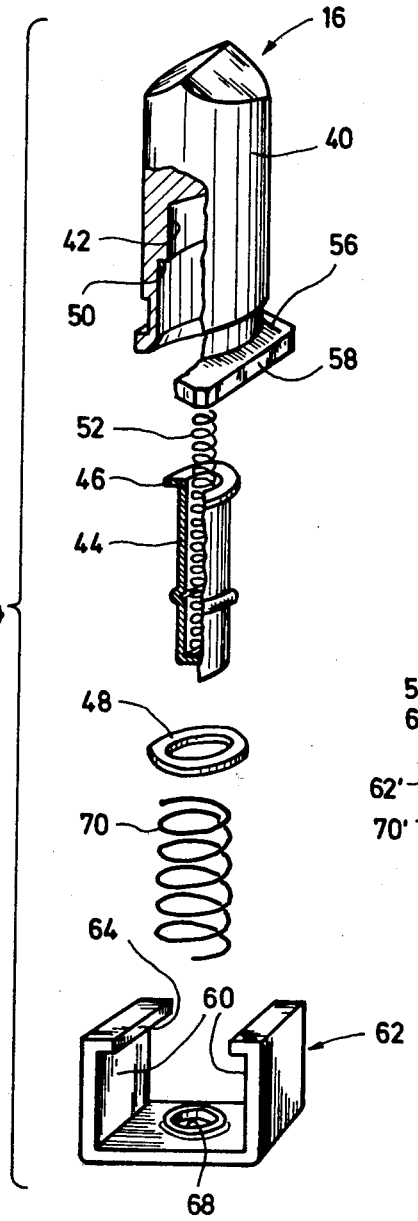
Fig. 4
Fig. 5
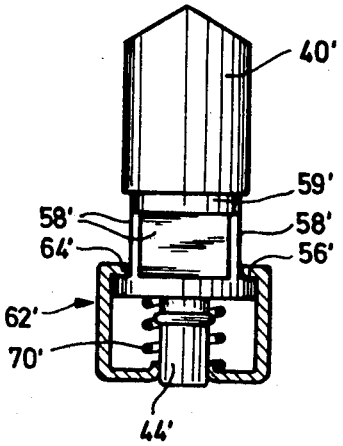

SIMPLIFIED LIMIT SWITCH CONSTRUCTION

The invention relates to a limit switch comprising a housing, at least one switch disposed within this housing and having a plunger for activation of the switch, said plunger being displaceable in a longitudinal direction inside a housing bore against the action of a return spring and also having an outer portion and an outwardly sprung inner portion telescoped into the outer portion, the latter being non-rotatably held in the housing via slide-guide surfaces on the plunger and on an anti-rotation element, i.e. an element for preventing relative rotation, non-rotatably disposed within the housing.

In the case of a known multiple limit switch put on the market by applicants' assignee the outer portions of the plungers have a collar, which has two flattened portions diametrically opposite each other, the outer portion of the plunger being non-rotatably held in the housing via these flattened portions and additional means which have still to be described. The outer portion of the housing has an inner groove running lengthwise to the row of plungers and vertically to the plunger axes, the ends of the plungers facing the switches being disposed in the groove, the sides of which run parallel to the plunger axes. Between the plungers small plate-like anti-rotation elements are inserted into this groove such that they are parallel to the plunger axes. If the thickness of these plate-like anti-rotation elements is adapted to the distance between plunger axes such that the flattened portions on the outer portions of the plungers abut on the anti-rotation elements the plungers may then be displaced within the housing but not rotated. In the case of this known construction each plunger also has a small abutment plate for the plunger return spring, which has a central hole and is thereby placed over the inner portion of the plunger projecting in the direction of its associated switch.

This known multiple limit switch is not simple to assemble and a standardisation of the plate-like anti-rotation elements is not possible. Since the multiple limit switches may have varying distances between the plunger axes anti-rotation elements with differing thicknesses for the plates must be produced, stored and assembled when standardised plungers are used; in addition, the plungers cannot be automatically assembled since the plunger return spring inserted into the pot-shaped outer portion of the plunger projects beyond the inner portion of the plunger when it is not tensioned so that the return spring abutment plate must be held on the inner portion of the plunger until the customary membrane plate enclosing the upper portion of the housing has been installed.

Another known anti-rotation means for the plunger of a limit switch (DE-GM No. 73 18 919) is also complicated. With this anti-rotation means two supporting and guide arms projecting into the interior of the housing parallel to the plunger axis are molded onto an approximately cubic housing portion which may be displaced in the plan view through 90°. These arms, together with a non-circular collar of the plunger, secure the plunger against relative rotation in this portion of the housing and firmly hold between them an abutment plate, penetrating through from the inner portion of the plunger, for the plunger return spring.

The object underlying the invention is, in a limit switch of the type described at the beginning, to prevent relative rotation of the outer portion of the plunger in a simpler way than has previously been the case—a plurality of plungers such as, for example, chisel or roller plungers can be actuated only from one specific direction so that it is important to hold them in a position having a specific angle of rotation within the limit switch housing.

The object set may be accomplished according to the invention in that the anti-rotation element forms an abutment for the return spring, has a cut-out for the inner portion of the plunger to pass through and is held against the outer portion of the plunger via stops on the anti-rotation element and the outer portion of the plunger, these stops being outwardly effective in axial direction and allowing the anti-rotation element to be displaced transversely to the plunger axis. In the case of the limit switch according to the invention the anti-rotation element therefore forms at the same time the abutment for the return spring; the assembly consisting of plunger, return spring and anti-rotation element forms a complete module and may be automatically preassembled since, when the plunger return spring is tensioned and the inner portion of the plunger pressed into the outer portion, the anti-rotation element merely has to be slid onto or into the plunger from the side until the inner portion of the plunger can catch in the cut-out of the anti-rotation element. Finally, this assembly also forms a complete force system which, inter alia, has the advantage that the return spring does not abut directly or indirectly on the customary membrane plate sealing the upper portion of the housing.

The designation "slide-guide surfaces" is, of course, not to be interpreted too narrowly since it would, for example, suffice for the plunger or the anti-rotation element to abut with one or more edges against a slide guidance of the other part extending in the direction of the plunger axis such that the plunger may not rotate relative to the housing.

It is also not absolutely necessary for the anti-rotation element to interact directly with the outer portion of the plunger since, when the inner portion of the plunger is secured in the outer portion of the plunger against relative rotation, it would also suffice for rotation of the inner portion of the plunger to be prevented by the anti-rotation element.

It must, of course, be possible to push the inner portion of the plunger into the outer portion such that it does not impede the anti-rotation element when this is slid onto the plunger.

The outer portion of the plunger and the anti-rotation element could be designed such that stops provided on the outer portion of the plunger engage over the anti-rotation element and form a type of channel, into which the anti-rotation element may be inserted from the side.

In the case of a preferred embodiment of the limit switch according to the invention the anti-rotation element is U-shaped and engages over the inner end of the plunger. In this respect it would also be possible to have stops provided on the outer portion of the plunger engaging over the stops of the anti-rotation element so that the latter only covers the end of the inner portion of the plunger facing the switch. It is, however, possible to work with conventionally designed plungers if the side arms of the anti-rotation element have as stops projections directed inwards towards each other and engaging behind outer shoulders of the outer portion of the plunger; it is then possible to use an outer portion of the plunger having a collar, a groove or a similar recess, which form the outer shoulders mentioned.

U-shaped abutments for the plunger return springs, which engage over the inner ends of the plunger and have a cut-out for the inner portion of the plunger to pass through, are known per se (DE-OS No. 26 15 238). These abutments do not, however, have the function of an anti-rotation element and they are also secured to the upper portion of the housing containing the plungers so that there is no complete unit consisting of the plunger, the plunger return spring and the return spring abutment which may be preassembled as a unit.

The invention is also suitable for implementation in the housing of a conventional multiple limit switch, which has an inner groove running lengthwise to the row of plungers and vertically to the plunger axes, since in this case one of the sides of the inner groove may be used to secure the anti-rotation element against relative rotation if the latter is designed such that after insertion into the inner groove it cannot be rotated relative to the housing. In a preferred embodiment of the invention the anti-rotation element is shaped like a clip, the outer edges of which form a parallelepiped.

Figure 2:
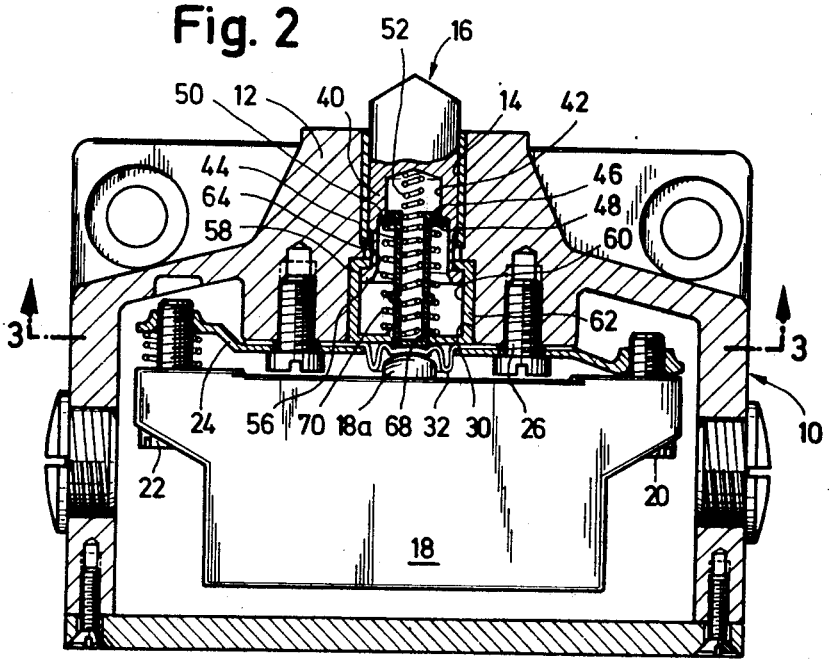
Figure 3:
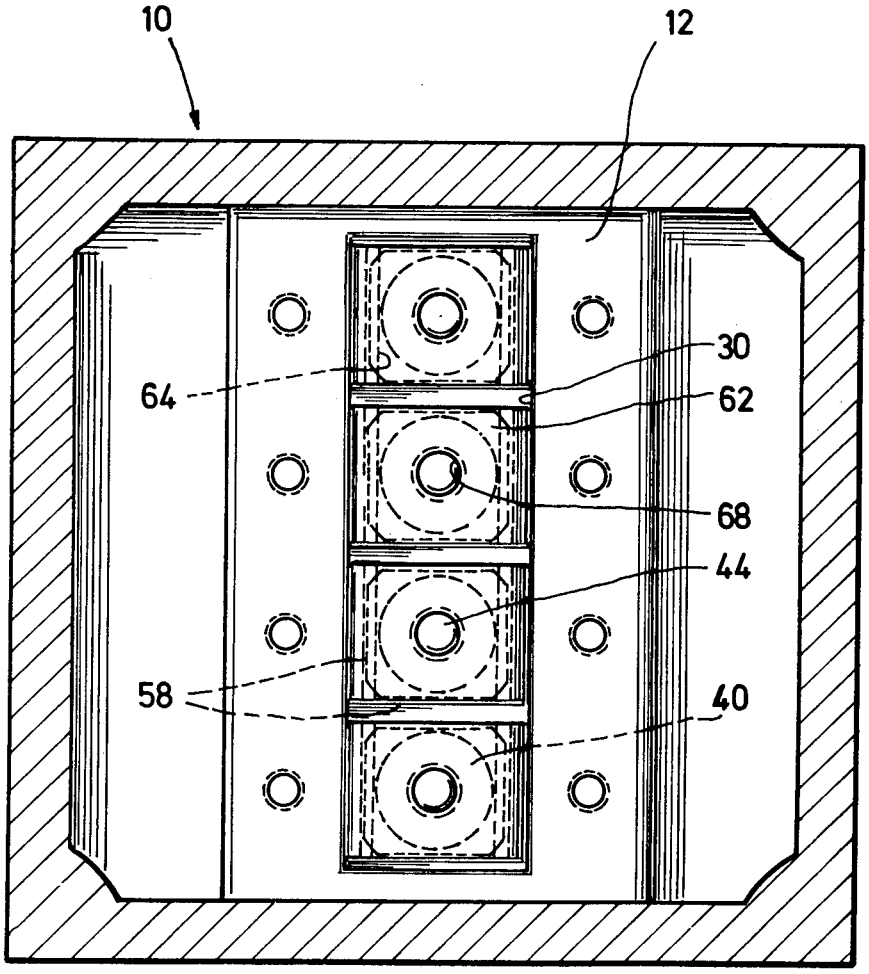

Additional features, advantages and details of the invention are given in the attached claims and/or the following specification as well as the attached drawings of two preferred embodiments of a limit switch according to the invention; the drawings show:

FIG. 1 a perspective view of a multiple limit switch using the first embodiment;

FIG. 2 a longitudinal section through this multiple limit switch along the line 2—2 in FIG. 1;

FIG. 3 a cross section through the multiple limit switch along the line 3—3 in FIG. 2;

FIG. 4 a perspective illustration of a module consisting of plunger, plunger return spring and anti-rotation element in the form of an exploded representation;

FIG. 5 a longitudinal section through a second embodiment of such a module.

The multiple limit switch shown in FIGS. 1 and 2 has a housing 10, in the upper portion 12 of which a row of bores 14 is provided for the plungers 16. An electrical switch 18 is associated with each of these plungers, the switch having a contact plunger 18*a* and being mounted on an assembly bar 24 with the aid of screws 20 and 22, this bar being secured to the upper portion 12 of the housing by screws 26.

The upper portion 12 of the housing also contains a groove 30, which is open towards the bottom and inwards, extends along the row formed by the plunger bores 14 or the plungers 16 and runs perpendicularly to the plunger axes. This groove is closed off by a membrane plate 32, which was secured to the upper portion 12 of the housing together with the assembly bars 24 with the aid of screws 26 and has for each plunger 16 or each contact plunger 18*a* a flexible membrane portion which is reciprocable in the direction of each plunger axis.

The construction of the preferred embodiment of the plunger assembly according to the invention will now be explained in detail on the basis of FIGS. 2 and 4.

A pot-shaped outer portion 40 of the plunger has a graduated bore 42 partially receiving an inner portion 44 of the plunger. This has a collar 46, which, after assembly, is located in the narrower part of the bore 42 and with which the inner portion of the plunger is secured in the outer portion 40 in that a ring 48 is pressed into the lower portion of bore 42 up to shoulder 50 of the bore. The collar 46 of the inner portion of the plunger abuts on this ring under the influence of an inner return spring 52 and the inner portion 44 of the plunger may be telescoped into the outer portion of the plunger against the action of this return spring.

The outer portion 40 of the plunger also has a collar 56 with two flattened portions 58 diagonally opposite each other, each of which constitutes one of the slide-guide surfaces serving to secure the outer portion of the plunger against relative rotation. Additional slide-guide surfaces 60 serving to prevent such relative rotation are formed by an anti-rotation element 62, which is, according to the invention, U-shaped, its outer edges forming, according to an additional feature of the invention, a parallelepiped (if, in the case of a single limit switch, a plunger displaceable through 90° is required the anti-rotation element is best given the form of a square, when viewed from below). This anti-rotation element has, according to the invention, two rib-like stops 64 projecting inwards towards each other to engage behind the collar 56 of the outer portion 40 of the plunger. A hole 68 is provided in the cross member of the anti-rotation element 62, through which the inner portion 44 may pass. Finally, an outer return spring 70 is located, according to the invention, between the ring 48 holding the inner portion 44 of the plunger and the anti-rotation element 62. The return springs 52 and 70 are adjusted to the forces required to activate the contact plunger 18*a* such that when the outer portion 40 of the plunger is pressed downwards the inner portion 44 of the plunger is first of all displaced with it until the control distance to the control plunger 18*a* has been overcome whereupon the inner portion 44 of the plunger is pressed into the outer portion 40 against the action of the inner return spring 52 in order to prevent any damage to the switch 18 and the membrane plate 32.

In order to assemble the anti-rotation element 62 on the plunger 16 the inner portion 44 of the plunger needs to be pressed into the outer portion 40 only until the anti-rotation element 62 can be slipped onto the outer portion 40 of the plunger from the side, and in a position, in which the stops 64 engage behind the collar 56.

As shown in FIG. 3 the width of the anti-rotation elements 62 corresponds to the width of the inner groove 30 so that the plungers, together with the anti-rotation elements, may be properly inserted from below into this inner groove and the plunger bores 14. Subsequently, the membrane plate 32, the assembly bar 24 and the switch 18 may be secured to the housing without difficulty.

The foregoing shows that the plunger system according to the invention does not require any alterations to the remaining parts of a single or multiple limit switch so that a conventional plunger system may be interchanged for a system according to the invention at any time. In addition, the distances between the plunger bores of multiple limit switches are not of importance with regard to either the design of the plunger system or the function of preventing relative rotation so that multiple limit switches of varying spacings may be equipped with one and the same plunger system.

The same applies for a modified embodiment of the plunger assembly, which is illustrated in FIG. 5 in a longitudinal section similar to that in FIG. 2. Since this second embodiment differs from the plunger assembly in FIGS. 2 to 4 only in the construction of its outer portion only this portion is described in the following.

The same reference numerals as those in FIGS. 1 to 4 have been used for the parts corresponding to the parts of the first embodiment, with the addition of an apostrophe.

As shown in FIG. 5 the outer portion 40' of the plunger has two flattened portions 58' diametrically opposite each other as well as at least one additional flattened portion 58' displaced through 90° relative to the first two flattened portions. These flattened portions end in steps forming stops 56' at a slight distance from the lower end of the outer portion 40' of the plunger, which is circular-cylindrical apart from these flattened portions and its chisel-shaped outer end, i.e. it has no collar. The anti-rotation element 62' abuts against the flattened portions 58' with its projections forming the stops 64' and thereby prevents relative rotation. At the same time the stops 64', 56' ensure that the assembly holds together and enable the anti-rotation element 62' to be slipped on from the side when the inner portion 44' of the plunger is depressed.

The flattened portions 58' may be connected to each other by grooves 59' extending in a circumferential direction such that the outer portion 40' of the plunger may be turned when it is pressed down. For this purpose the amount of displacement of the outer portion 40' of the plunger allowed by the anti-rotation element 62' corresponds to the distance between the grooves 59' and the stops 56' and the diameter of the outer portion 40' of the plunger at the base of grooves 59' to the distance between the stops 64' of the anti-rotation element 62'. In addition, the space between the grooves 59' and the stops 64' of the anti-rotation element when the plunger is not pressed down must be larger than the plunger displacement occurring during normal operation so that the outer portion 40' of the plunger does not turn unintentionally.

The outer portion 40' of the plunger according to the second embodiment is cheaper to manufacture since it has no collar and the flattened portions 58' of the otherwise cylindrical outer portion of the plunger may be simply cut.

We claim:

1. Limit switch comprising a housing, at least one switch disposed within this housing and having a plunger for activation of said switch, said plunger being displaceable in a longitudinal direction inside a housing bore against the action of a return spring and also having an outer portion and an outwardly sprung inner portion telescoped into said outer portion, the latter being non-rotatably held in the housing via slide-guide surfaces on the plunger and on an anti-rotation element non-rotatably disposed within the housing, characterized in that the anti-rotation element forms an abutment for the return spring, has a cut-out for the inner portion of the plunger to pass through and is held against the outer portion of the plunger via stops on the anti-rotation element and the outer portion of the plunger, said stops being outwardly effective in axial direction allowing the anti-rotation element to be displaced transversely to the plunger axis.

2. Limit switch according to claim 1, characterized in that the anti-rotation element is U-shaped and engages over the inner end of the plunger.

3. Limit switch according to claim 2, characterized in that the side arms of the anti-rotation element 62 have as stops projections directed inwards towards each other, which engage behind outer shoulders of the outer portion of the plunger.

4. Limit switch according to claim 3, characterized in that the outer shoulders of the outer portion of the plunger are formed by a collar, and a groove or a similar recess.

5. Limit switch according to any one of the preceding claims, characterized in that the anti-rotation element has at least one slide-guide surface facing the plunger and parallel to the plunger axis, an edge of the outer portion of the plunger, in particular an edge of a collar thereon, abutting against said slide-guide surface in order to prevent relative rotation.

6. Limit switch according to claim 4, characterized in that the outer portion of the plunger has a cylindrical circumference apart from at least two recesses designed as flattened portions parallel to the plunger axis and diametrically opposite each other, and that the flattened portions end at a distance from the inner end of the outer portion of the plunger and thereby form stops for the projections of the anti-rotation element, said projections being directed inwards and, together with the flattened portions, preventing relative rotation.

7. Limit switch according to claim 6, characterized in that the outer portion of the plunger has at the upper end of the flattened portions circumferential grooves connecting the flattened portions with each other and enabling the outer portion of the plunger to turn relative to the anti-rotation element.

8. Multiple limit switch according to any one of claims 1–4, 6 or 7 comprising a row of said switches in said housing, each switch having a plunger and having an anti-rotation element, characterized in that the housing has an inner groove running lengthwise to the row of plungers and perpendicularly to the plunger axes, at least one of the sides of said inner grooves serving to secure the anti-rotation elements against rotation.

9. Limit switch according to any one of claims 1–4, 6 or 7, characterized in that the anti-rotation element is rectangular in shape when viewed from above and from within the housing.

* * * * *